US007036231B2

(12) United States Patent
Lüttgens

(10) Patent No.: US 7,036,231 B2
(45) Date of Patent: May 2, 2006

(54) SHARPENER FOR AN OVAL PENCIL

(75) Inventor: Fritz Lüttgens, Erlangen (DE)

(73) Assignee: KUM Limited, Trim (IE)

( * ) Notice: Subject to any disclaimer, the term of this patent is extended or adjusted under 35 U.S.C. 154(b) by 86 days.

(21) Appl. No.: 10/850,924

(22) Filed: May 21, 2004

(65) Prior Publication Data

US 2005/0257386 A1 Nov. 24, 2005

(51) Int. Cl.
*B43L 23/08* (2006.01)

(52) U.S. Cl. ..... 30/457; 30/454; 30/461

(58) Field of Classification Search ..... 30/451, 30/453, 454, 457, 461
See application file for complete search history.

(56) References Cited

U.S. PATENT DOCUMENTS

| | | | | |
|---|---|---|---|---|
| 4,081,010 | A | 3/1978 | Galli | 30/451 |
| 4,506,716 | A * | 3/1985 | Hayashi | 30/457 |
| 6,092,293 | A * | 7/2000 | Donaldson | 30/457 |
| 6,279,238 | B1 * | 8/2001 | Gillson | 30/456 |
| 6,571,480 | B1 * | 6/2003 | Qiu | 30/457 |
| 2005/0044730 | A1 * | 3/2005 | Fischer | 30/454 |
| 2005/0091857 | A1 * | 5/2005 | Smith et al. | 30/457 |

FOREIGN PATENT DOCUMENTS

| | | |
|---|---|---|
| DE | 2555564 | 9/1976 |
| DE | 7629766 | 1/1978 |
| DE | 10055008 A1 | 5/2002 |

* cited by examiner

*Primary Examiner*—Hwei-Siu Payer
(74) *Attorney, Agent, or Firm*—Laurence A. Greenberg; Werner H. Stemer; Ralph E. Locher

(57) ABSTRACT

A sharpener includes a sharpener body, a guide collar and a shaving blade. The guide collar has an oval bore defining a pencil-guiding channel and is mounted on the sharpener body such that it can be rotated essentially about the axis of the pencil-guiding channel. The shaving blade is fastened on a blade holder of the sharpener body to be positioned axially offset in relation to the guide collar and obliquely in relation to the axis of the pencil-guiding channel. A concave guide contour, into which the shaving blade projects by way of a cutting edge is formed on an inner surface of the blade holder adjacent to the pencil-guiding channel. When the pencil positioned in the pencil-guiding channel is rotated in relation to the sharpener body, the axis of the pencil-guiding channel is guided on an essentially oval path in relation to the cutting edge.

9 Claims, 4 Drawing Sheets

Fig. 1
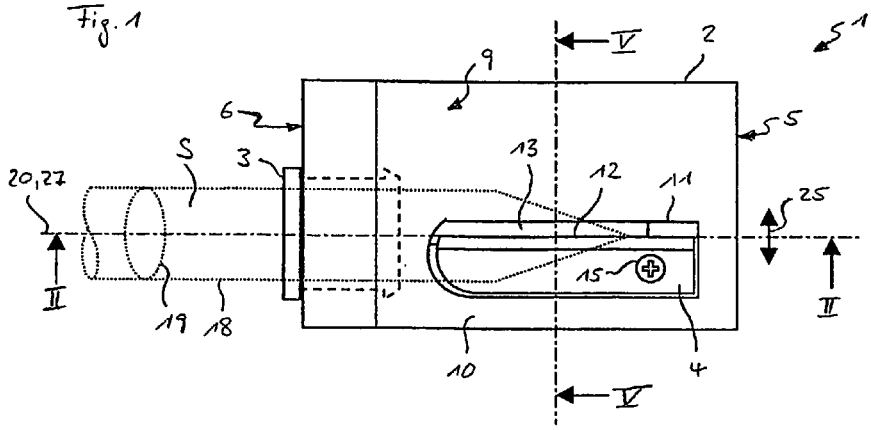
Fig. 2
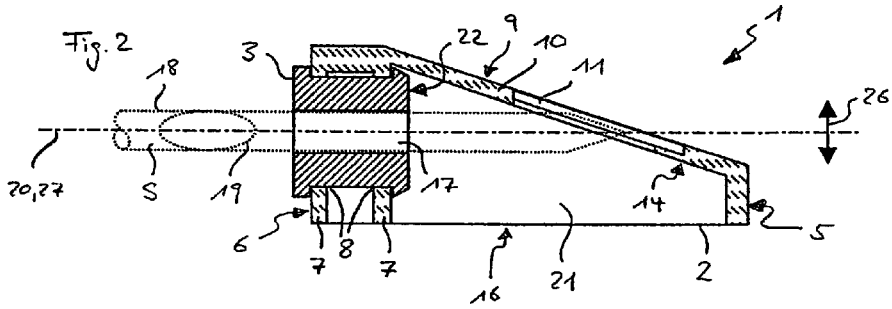
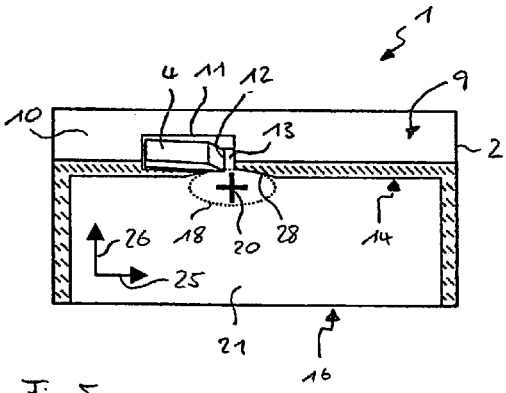
Fig. 5
Fig. 3
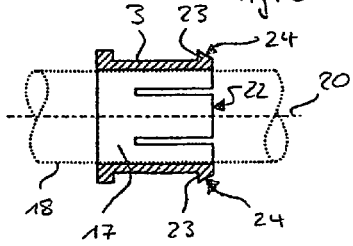
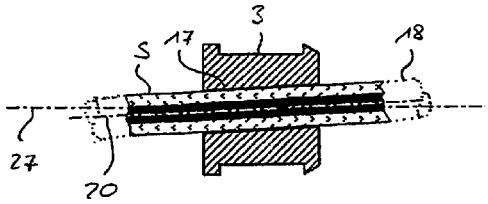
Fig. 4

Fig. 11
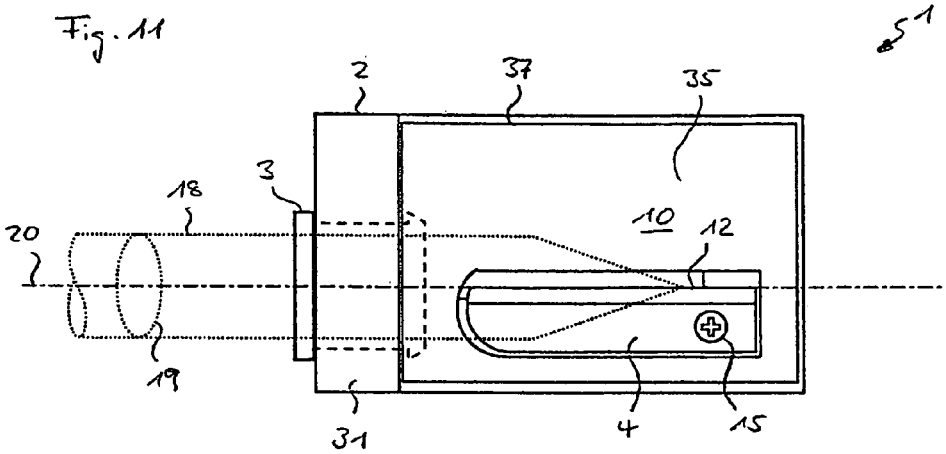
Fig. 12
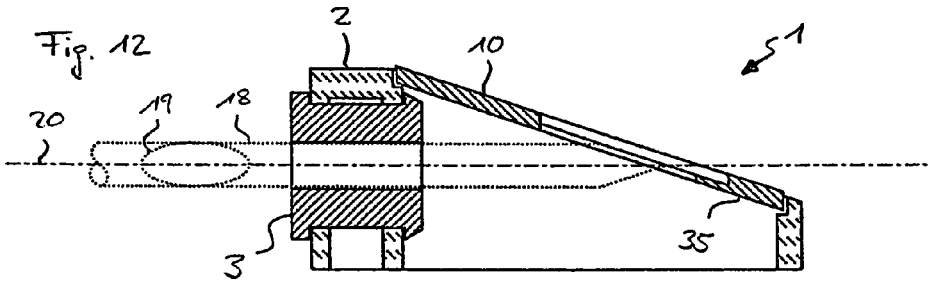
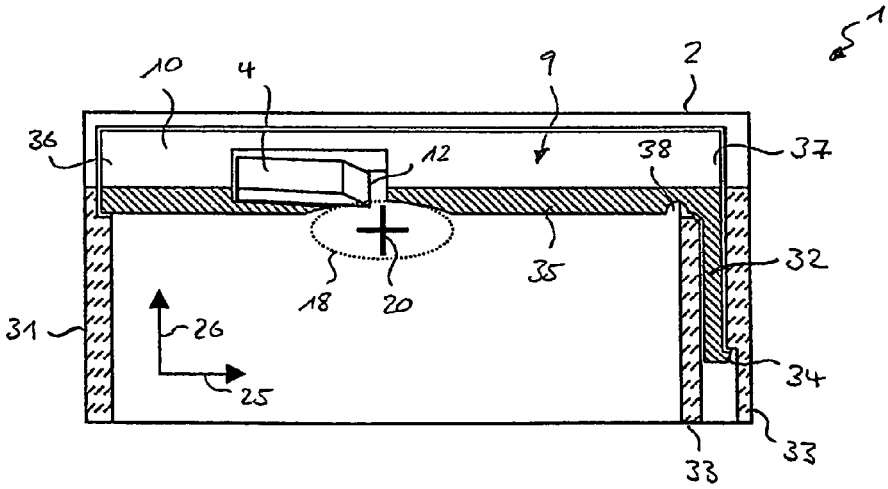
Fig. 13

SHARPENER FOR AN OVAL PENCIL

BACKGROUND OF THE INVENTION

Field of the Invention

The invention relates to a sharpener for an oval pencil, having a sharpener body, having a guide collar which is provided with an oval bore defining a pencil-guiding channel, and which is mounted on the sharpener body such that it can be rotated essentially about the axis of the pencil-guiding channel, and having a shaving blade which is fastened on a blade holder of the sharpener body such that it is positioned in an axially offset manner in relation to the guide collar and obliquely in relation to the axis, a concave guide contour, into which the shaving blade projects by way of a cutting edge, being formed on an inner surface of the blade holder which is adjacent to the pencil-guiding channel.

Such a sharpener is known from DE 76 29 766 U1. In the case of the known sharpener, the guide collar is guided in the sharpener body such that it can be displaced along a normal direction which runs perpendicularly to the axis of the pencil-guiding channel and approximately perpendicularly to the blade surface. The tip of the pencil which is to be sharpened is pressed against the shaving blade by a spring-loaded pressure-exerting body, which has a mating contour curved in the opposite direction to the concave guide contour.

A further sharpener of the abovementioned type is known from DE 100 55 008 A1. In this document, the guide collar, and thus the axis of the pencil-guiding channel, is arranged in a stationary manner in a sharpener housing which forms the sharpener body. In contrast, the blade holder, and thus the shaving blade, can be displaced along the normal direction.

Conventional sharpeners of the abovementioned type often have the problem of the pencil only being shaved non-uniformly along the circumference of its tip during the sharpening operation. This is frequently associated with the pencil "catching" on the shaving blade, i.e. with rotation being opposed by an abruptly fluctuating torque. This is unpleasant for handling reasons and may result in the pencil surface splintering in the region of the tip of the pencil or even in the pencil core breaking off.

Furthermore, it is known from DE 25 55 564 B2, in the case of a sharpener for an oval pencil, for a guide collar for the pencil to be provided with a plurality of cams which, when the guide collar is rotated in relation to a sharpener body, roll over corresponding stops of the sharpener body. As a result, the axis of a pencil pushed into the guide collar is guided in relation to the sharpener body, when the pencil is rotated, such that the lateral surface of the pencil always remains in contact with the cutting edge of the shaving blade. The known sharpener, however, is of comparatively complicated construction and is thus disadvantageous for production reasons.

SUMMARY OF THE INVENTION

The object of the invention is to specify a sharpener which is of straightforward design and thus, in particular, is inexpensive to realize and is particularly suitable for sharpening an oval pencil.

This object is achieved according to the invention by the features of claim 1. Accordingly, for a sharpener of the type mentioned in the introduction, it is provided that the guide contour and guide collar are designed such that, when the pencil positioned in the pencil-guiding channel defined by the guide collar is rotated in relation to the sharpener body, the axis of the pencil-guiding channel is guided on an essentially oval path in relation to the cutting edge of the shaving blade.

The invention is based on the knowledge that the functional drawbacks of conventional sharpeners of the generic type are attributable to the fact that, in these sharpeners, the pencil axis and the cutting edge of the shaving blade, during sharpening, are merely displaced in relation to one another along the normal direction perpendicular to the pencil axis. This is because this results in the lateral surface of the pencil butting smoothly against the cutting edge only in the regions where the radius of the pencil is at a minimum or a maximum. Between these regions, the lateral surface of the pencil usually lifts off from the cutting edge of the shaving blade, which results in the above described malfunctioning. If, in contrast, the lateral surface of the oval pencil is rolled precisely over the cutting edge, as is the case with the sharpener known from DE 25 55 564 B2, then the pencil axis describes an oval path in relation to the cutting edge in cross-sectional projection, that is to say it moves both in the normal direction in relation to the cutting edge and, perpendicularly thereto, in the lateral direction.

The invention takes as its basis the consideration of using simplified design means to achieve this elliptical guidance of the pencil axis when the pencil is rotated in relation to the sharpening body. This design simplification is achieved, as is known, with the aid of a concave guide structure in the region of the cutting edge, as has already been disclosed by DE 76 29 766 U1 (FIG. 2 of the latter) and DE 100 55 008 A1 (FIG. 5 of the latter). According to the invention, by means of this guide contour, the force which presses the pencil against the shaving blade in the normal direction is partially redirected in the lateral direction and the pencil axis is thus deflected in accordance with the desired oval path parallel to the shaving blade. In the prior art, in contrast, the guide contour is always used together with a complementary mating contour which is forced in the direction of the shaving blade. In this conventional configuration, the lateral forces to which the pencil is subjected by the guide contour and mating contour compensate for one another, with the result that the pencil axis does not experience any lateral displacement in relation to the cutting edge. As is known, however, it is not sufficient just to omit the mating contour. Rather, the guide collar has to be additionally configured such that the pencil axis (and thus the axis of the pencil-guiding channel) has the necessary lateral freedom of movement at the axial height of the cutting blade. In the case of the known sharpeners, for example, the pencil axis would not be guided along the desired oval path even if the mating contour were omitted, especially since the pencil axis here, by its very nature, is guided in a stationary manner in the sharpener body at least in the lateral direction.

There are a number of advantageous variants of providing the axis of the pencil-guiding channel with the necessary lateral freedom of movement. On the one hand, in this respect, provision is made for mounting the guide collar in the sharpener body with play, in particular, in the lateral direction. As an alternative, or in addition, it is provided that this play is obtained from the guide collar itself by the guide collar being formed from an elastic material, with the result that, on account of this elasticity, the wall of the bore provided in the guide collar is flexible such that a pencil pushed into the guide collar (and thus the axis of the pencil-guiding channel) can be pivoted slightly in relation to the axis of the guide collar.

With sufficiently flexible guidance of the axis of the pencil-guiding channel by way of the guide collar, it is possible for the shaving blade, as is provided in a particularly straightforward embodiment of the invention, to be fixed in a stationary manner on the sharpener body. However, particularly good sharpening behavior is achieved in a preferred embodiment of the sharpener in which the shaving blade can be deflected elastically essentially in the normal direction. This can be realized particularly straightforwardly in design terms by the blade holder being formed as a resilient lug which is made of an elastic material, in particular an elastic polymer material, and is connected to the rest of the constituent parts of the sharpener body along a side line or side edge.

The blade holder designed in this way is preferably fixed on the sharpener body along a side line which is Essentially parallel to the cutting edge, especially since in this way, with the elastic deflection of the blade holder during the sharpening operation, the positioning angle of the shaving blade remains essentially constant in relation to the pencil axis. Furthermore, in particular in the vicinity of the line along which it is connected to the sharpener body, the blade holder expediently has a predetermined bending location.

In an advantageous development of the invention, the guide collar is snapped into a corresponding bearing bore of the sharpener body, it being possible for this snap-in connection to be released without being destroyed. This allows, for example, a straightforward exchange of different guide collars which are provided for different pencil cross sections.

It is preferable, furthermore, for the surface of the shaving blade to be positioned slightly obliquely in relation to the tangent to the pencil-guiding channel at the location of the cutting edge. It has been found that a particularly good cutting behavior can be achieved as a result.

BRIEF DESCRIPTION OF THE DRAWINGS

Exemplary embodiments of the invention are explained in more detail hereinbelow with reference to a drawing, in which:

FIG. 1 shows, in a plan view from above, a sharpener for an oval pencil, having a sharpener body, having a guide collar defining a pencil-guiding channel, and having a shaving blade, FIG. 2 shows the sharpener according to FIG. 1 in a longitudinal section II—II, FIG. 3 shows, in longitudinal section, the guide collar in a position in which it has been rotated through 90° in relation to FIG. 2, FIG. 4 shows, in an illustration according to FIG. 2, the guide collar with a pencil pushed into it, the guide collar being deformed elastically by the pencil for deflection of the axis of the pencil-guiding channel in relation to the axis of the guide collar, FIG. 5 shows the sharpener according to FIG. 1 in a cross section A—A, FIG. 11 shows, in an illustration according to FIG. 1, an alternative embodiment of the sharpener with an elastically deflectable blade holder, FIG. 12 shows, in an illustration according to FIG. 2, the sharpener according to FIG. 11 with the blade holder not deflected, FIG. 13 shows, in an illustration according to FIG. 5, the sharpener according to FIG. 11 with the blade holder not deflected.

DESCRIPTION OF THE PREFERRED EMBODIMENTS

Figure 6:
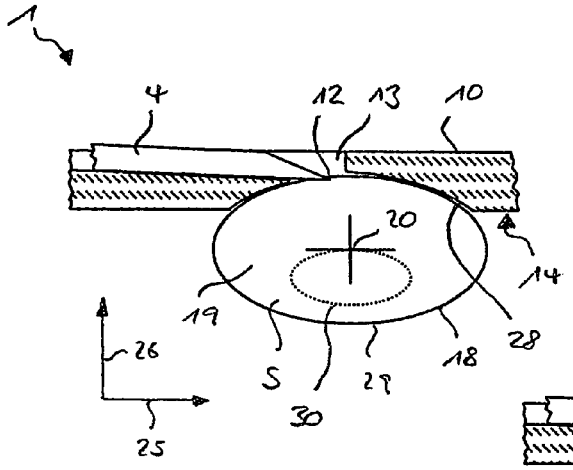
FIGS. 6–10 show, each in cross-sectional illustrations analogous to FIG. 5 which have been enlarged in detail form, five rotary positions of the pencil-guiding channel in relation to the cutting edge of the shaving blade.
Figure 7:
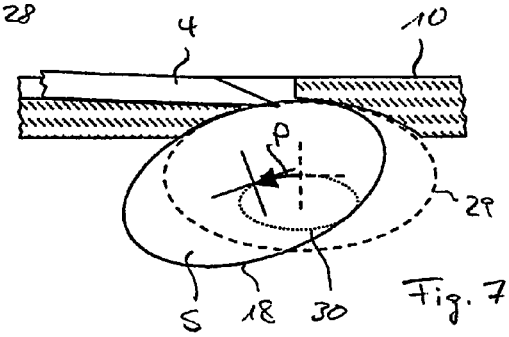
Figure 8:
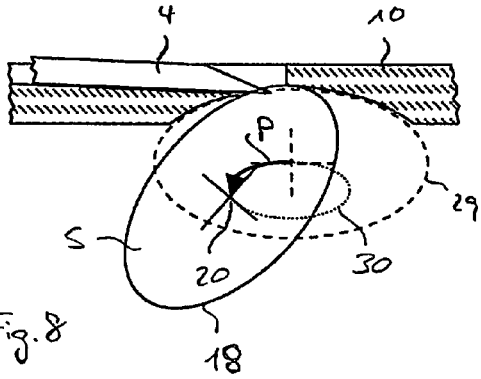
Figure 9:
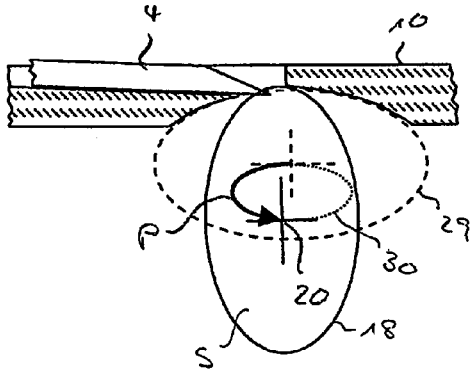

Parts which correspond to one another are always provided with the same designations in all the figures.

The sharpener 1, which is illustrated in a plan view from above in FIG. 1, a longitudinal section in FIG. 2 and in cross section in FIG. 5, comprises a housing-like sharpener body 2 made of metal or polymer material, a guide collar 3 for a pencil S, and a shaving blade 4.

The sharpener body 2 is an essentially wedge-shaped design with a flattened wedge tip 5. On the wedge base 6, which is directed away from the wedge tip 5, the sharpener body 2 is provided with a base wall 7 configured as a double wall. Introduced into the base wall 7 is a bearing bore 8 in which, in turn, the guide collar 3 is mounted in a rotatable manner (in FIG. 1, that part of the guide collar 3 which is concealed by the sharpener body 2 is indicated by dashed lines).

A wall arranged on the wedge slope 9 of the sharpener body 2 serves as a blade holder 10. The blade holder 10 has a mount 11 in which the shaving blade 4 is positioned such that it projects slightly, by way of a cutting edge 12, through a shaving-discharge slot 13 in relation to an inner surface 14 of the blade holder 10. The shaving blade 4 is fixed on the blade holder 10 by means of a fastening screw 15. The sharpener body 2 is open in the direction of the horizontal surface 16 of the wedge shape.

The guide collar 3, which is illustrated in longitudinal sections which have been rotated through 90° in relation to one another in FIGS. 2 and 3, is essentially in the form of a sleeve and is provided with a central bore 17 for accommodating the pencil S, which has an oval cross section adapted to the envisaged pencil cross section. In the normal state of the guide collar 3 which is shown in FIGS. 2 and 3, the bore 17 is formed coaxially with the circular outer circumference of the guide collar 3.

The bore 17 defines a pencil-guiding channel 18. The pencil-guiding channel 18 referred to is the abstract volume which the pencil S pushed into the sharpening position in the guide collar 3 takes up in relation to the sharpener 1. The pencil-guiding channel 18 is obtained essentially by the interior of the bore 17 and the imaginary extension of the latter outside the guide collar 3. In particular, the pencil-guiding channel 18 has an oval cross section 19 corresponding to the cross section of the bore 17 and the pencil cross section. Furthermore, the axis of the bore 17 defines an axis 20 of the pencil-guiding channel 18.

The guide collar 3 is snapped into the bearing bore 8 of the sharpener body 2. In order to allow the guide collar 3 to be snapped in, it is slotted a number of times starting from its end 22 which is directed toward the interior 21 of the sharpener body 2 (FIG. 3). Furthermore, an annular guide collar 23 provided at the inner end 22 of the guide collar 3 is provided with a slide-on slope 24, which makes it easier for the guide collar 3 to be introduced into the bearing bore 8. The guide collar 3 is preferably designed such that it can also be removed again from the sharpener body 2 without being destroyed. As a result, it is possible, in particular, for different guide collars 3 which are provided for different pencil cross sections to be exchanged for one another.

In order to give the pencil axis (and thus the axis 20 of the pencil-guiding channel 18) a certain freedom of movement in relation to the sharpener body 2, the guide collar 3 is mounted in the bearing bore 8 with a little play, in particular, in the lateral direction 25. The lateral direction 25 referred to here is the direction which is perpendicular to the axis 20 in a cross-sectional projection according to FIG. 5 and is oriented approximately parallel to the surface of the shaving blade 4. More precisely, the lateral direction 25 is defined by the tangent with the circumference of the pencil-guiding channel 18 at the point of contact with the cutting edge 12. The surface of the shaving blade 4 is preferably swung out slightly in relation to the lateral direction 25. The direction which is perpendicular both to the axis 20 and to the lateral direction 25, and is thus oriented approximately perpendicularly to the surface of the shaving blade 4, is referred to as the normal direction 26.

Furthermore, the guide collar 3 is produced from a polymer material which is comparatively soft and can thus be subjected to slight elastic deformation. This material serves, in turn, to provide the axis 20 of the pencil-guiding channel 18 with a certain amount of play in relation to the sharpener body 2. As is shown in a highly exaggerated schematic illustration in FIG. 4, it is possible for the wall of the bore 17 to be deformed by means of a pencil S pushed into the bore 17 and for the pencil axis (and thus the axis 20 of the pencil-guiding channel 18) thus to be deflected slightly in relation to the axis 27 of the guide collar 3.

This freedom of movement of the axis 20 in relation to the sharpener body 2 is utilized according to the invention in order for it to be possible during the sharpening operation, i.e. when the pencil S pushed into the sharpening position in the guide collar 3 is rotated in relation to the sharpener body 2, for the axis 20 to be deflected in relation to the cutting edge 12, at the axial height of the shaving blade 4, both in the lateral direction 25 and in the normal direction 26. As is illustrated hereinbelow with reference to FIGS. 6 to 10, this allows good guidance of the pencil surface along the cutting edge 12.

Each of FIGS. 6 to 10 shows a schematically enlarged cross-sectional illustration of the blade holder 10 in the region of the shaving-discharge slot 13 with the shaving blade 4 positioned thereon. FIGS. 6 to 10 also show—corresponding to continued rotation of the pencil S—a respectively different rotary position of the pencil-guiding channel 18. It can be seen in FIGS. 6 to 10, in particular, that provided as guide contour 28 on the inner surface 14 of the blade holder 10, in the region of the shaving-discharge slot 13, is a concave curvature, in which the pencil-guiding channel 18 is positioned. The curvature of this guide contour 28 corresponds approximately to the minimal curvature of the oval cross-sectional surface 19 of the pencil-guiding channel 18, with the result that in the illustration according to FIG. 6, in which the long half-axis of the oval cross-sectional surface 19 is aligned, the guide contour 28 fits closely essentially against the circumference of the pencil-guiding channel 18.

If then, during the sharpening operation, the pencil S is rotated in relation to the original position 29 according to FIG. 6 (indicated by dashed lines in FIGS. 7 to 10), then some of the force by which the pencil S is pressed against the shaving blade 4 along the normal direction 26 is deflected in the lateral direction 25 on the guide contour 28. The pencil-guiding channel 18 and thus also the axis 20 thereof are thus deflected along the lateral direction 25 in the direction of the cutting edge 12 (see FIGS. 7 and 8). As rotation continues, the pencil-guiding channel 18, according to FIG. 9, reaches a position in which its long half-axis is oriented approximately in the normal direction 26. In the region of this angled position of the pencil-guiding channel 18, the guide contour 28 subjects the pencil S only to a comparatively small lateral force, if any at all, with the result that the axis 20 of the pencil-guiding channel 18 returns again to a lateral position corresponding to the original position according to FIG. 6, although a different normal position is assumed in relation to the original position 29.

Figure 10:
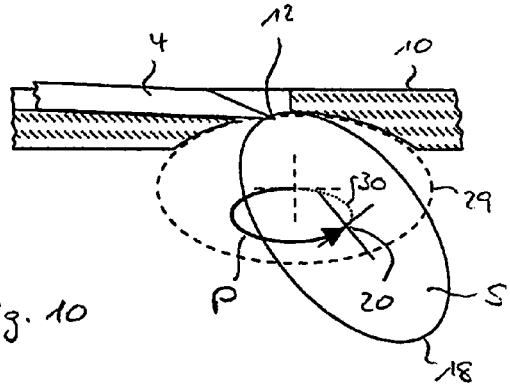
Figure 14:
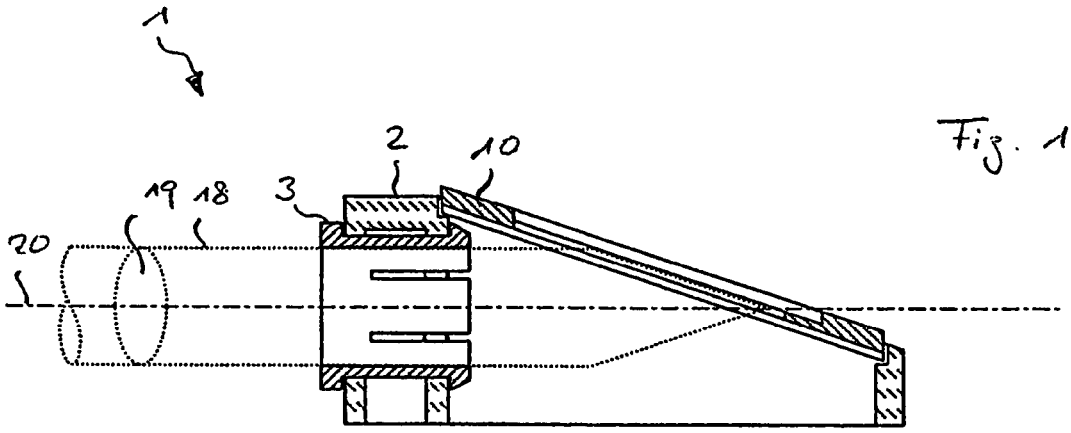
FIG. 14 shows, in an illustration according to FIG. 12, the sharpener according to FIG. 11 with the blade holder deflected.
Figure 15:
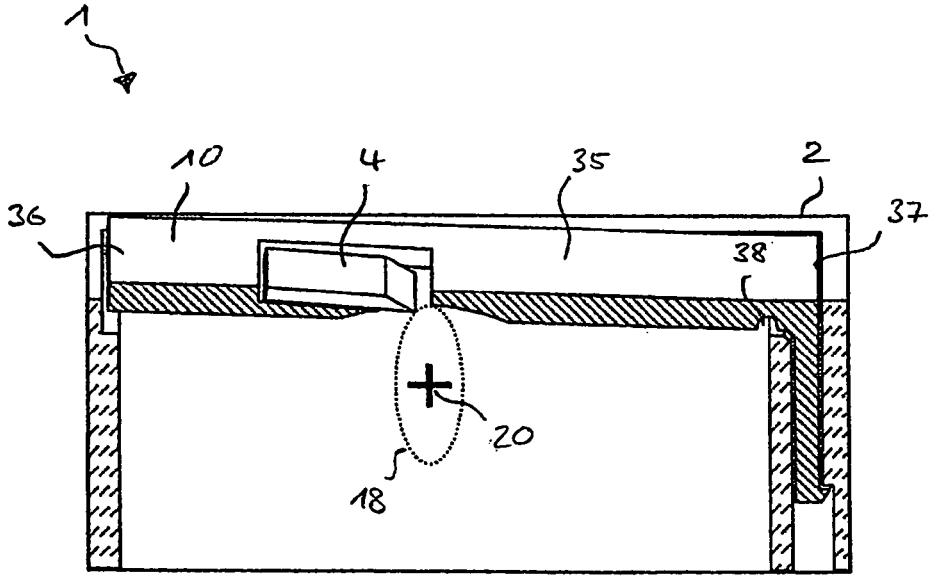
FIG. 15 shows, in an illustration according to FIG. 13, the sharpener according to FIG. 11 with the blade holder deflected.

As the pencil S rotates further, according to FIG. 10, the axis 20 of the pencil-guiding channel 18 is deflected laterally beyond the zero position according to FIG. 6. This is attributable, in particular, to the fact that the cutting edge 12 of the shaving blade 4, this cutting edge engaging with the pencil circumference, subjects the pencil S to an opposing torque.

If one looks at the change in position of the axis 20 over the course of FIGS. 6 to 10, then it becomes clear that, by the interaction of the guide contour 28, of the cutting edge 12 of the shaving blade 4 and of the guidance of the pencil S in the guide collar 3, the axis 20 is guided over a continuous oval path 30 during each half-rotation of the pencil-guiding channel 18. For illustrative purposes, this path 30 is depicted as a dotted line in FIGS. 6 to 10. The route along the path 30 which is taken by the axis 20 starting from the original position 29 to the position which is illustrated in FIGS. 7, 8, 9, 10 is indicated by an arrow P in FIGS. 7 to 10.

FIGS. 11 to 15 illustrate an alternative embodiment of the sharpener 1. This embodiment differs from the above described embodiment in that the sharpener body 2 is designed in two parts. The sharpener body 2 here comprises a frame 31, produced in particular from metal, and the blade holder 10, which is configured as a separate part. The blade holder 10 is of cross-sectionally L-shaped design and consists of elastically flexible polymer material. A vertical leg 32 of the L-shaped blade holder 10 engages in a side wall 33 of the frame 31, this side wall being configured as a double wall, and is latched there by a protrusion 34, which engages in a corresponding mount of the side wall 33. The horizontal leg 35 of the blade holder 10 forms the wedge slope 9 of the sharpener body 2, which, in turn, is wedge-shaped overall, and bears the shaving blade 4, as in the variant described above.

The free end 36 of the horizontal leg 35 just rests loosely on the frame 31. The blade holder 10 is thus connected to the rest of the constituent parts of the sharpener body 2 merely in the region of the vertical leg 32 and thus, in the plan view according to FIG. 11, merely along a side line 37, with the result that the horizontal leg 35 can be deflected elastically in the manner of a resilient lug. As a result, the cutting edge 12 of the shaving blade 4 can be deflected resiliently in the normal direction 26 in relation to the axis 20 of the pencil-guiding channel 18. The pivotability of the horizontal leg 35 is improved by a predetermined bending location 38 which is introduced into the blade holder 10 at the start of the horizontal leg 35, and thus at a small distance from, and parallel to, the side line 37.

The resilient suspension of the shaving blade 4 improves the sharpening behavior of the sharpener 1. In particular, in this configuration, the shaving blade 4 yields slightly when the pencil S is pushed into the guide collar 3, for sharpening purposes, with excessive force, and thus prevents the pencil core from breaking off. In addition, the shaving blade 4 yields if the pencil-guiding channel 18 is displaced through approximately 90° from the lateral position illustrated in FIGS. 13 and 14 into a normal position. This position of the pencil-guiding channel 18, which corresponds with an elastically deflected position of the blade holder 10, is illustrated in FIGS. 12 and 13.

| List of designations |
|---|
| 1 Sharpener |
| 2 Sharpener body |
| 3 Guide collar |
| 4 Shaving blade |
| 5 Wedge tip |
| 6 Wedge base |
| 7 Base wall |
| 8 Bearing bore |
| 9 Wedge slope |
| 10 Blade holder |
| 11 Mount |
| 12 Cutting edge |
| 13 Shaving-discharge slot |
| 14 Inner surface |
| 15 Fastening screw |
| 16 Horizontal surface |
| 17 Bore |
| 18 Pencil-guiding channel |
| 19 Cross section |
| 20 Axis |
| 21 Interior |
| 22 End |
| 23 Guide collar |
| 24 Slide-on slope |
| 25 Lateral direction |
| 26 Normal direction |
| 27 Axis |
| 28 Guide contour |
| 29 Position |
| 30 Path |
| 31 Frame |
| 32 Vertical leg |
| 33 Horizontal leg |
| 34 Protrusion |
| 35 Horizontal leg |
| 36 Free end |
| 37 Side line |
| 38 Predetermined bending location |
| S Pencil |

I claim:

1. A sharpener for an oval pencil, comprising:

a sharpener body formed with a blade holder;

a guide collar formed with an oval bore defining a pencil-guiding channel having an axis; and rotatably mounted on said sharpener body for rotation substantially about said axis of said pencil-guiding channel;

a shaving blade with a cutting edge fastened to said blade holder of said sharpener body and positioned with an axial offset relative to said guide collar and obliquely relative to said axis of said pencil-guiding channel;

said blade holder having an inner surface formed with a concave guide contour adjacent said pencil-guiding channel, and said shaving blade projecting with said cutting edge into said concave guide contour;

said guide contour and said guide collar being configured such that, when the pencil positioned in said pencil-guiding channel is rotated relative to said sharpener body, said axis of said pencil-guiding channel is guided on a substantially oval path relative to said cutting edge.

2. The sharpener according to claim 1, wherein said guide collar is mounted to said sharpener body with play.

3. The sharpener according to claim 1, wherein said guide collar is formed of an elastic material allowing deformation of a wall of said bore for deflecting said axis of said pencil-guiding channel relative to an axis of said guide collar.

4. The sharpener according to claim 1, wherein said blade holder is configured to be deflected elastically in a normal direction substantially radial relative to said pencil-guiding channel and substantially perpendicular to a surface of said shaving blade in a cross-sectional projection.

5. The sharpener according to claim 4, wherein said blade holder is a resilient lug connected to said sharpener body along a side line.

6. The sharpener according to claim 5, wherein said blade holder is connected to said sharpener body along said side line extending substantially parallel to said cutting edge.

7. The sharpener according to claim 5, wherein said blade holder is formed with a predetermined bending location extending substantially parallel to the side line.

8. The sharpener according to claim 1, wherein said sharpener body is formed with a bearing bore, and said guide collar is configured to be snapped into said bearing bore and to be released therefrom without being destroyed.

9. The sharpener according to claim 1, wherein said shaving blade has a surface positioned obliquely relative to a tangent of a circumference of said pencil-guiding channel at a point of contact with said cutting edge.

* * * * *